US006554682B1

(12) United States Patent
Tammera

(10) Patent No.: US 6,554,682 B1
(45) Date of Patent: Apr. 29, 2003

(54) TOY LIQUID STORAGE TANK

(76) Inventor: Robert F. Tammera, 7081 Auburn Mill Rd., Warrenton, VA (US) 20187

( * ) Notice: Subject to any disclaimer, the term of this patent is extended or adjusted under 35 U.S.C. 154(b) by 0 days.

(21) Appl. No.: 10/047,951

(22) Filed: Jan. 17, 2002

(51) Int. Cl.[7] ..... A63H 3/52; A63H 33/50

(52) U.S. Cl. ..... 446/476; 446/153; 446/156

(58) Field of Search ..... 446/476–478, 446/91, 153, 156, 158, 159, 180, 199, 246, 241

(56) References Cited

U.S. PATENT DOCUMENTS 3,074,078 A * 1/1963 Varian ..... 210/169
3,457,670 A * 7/1969 Lewis ..... 446/153
4,458,440 A * 7/1984 D'Andrade et al. ..... 446/424

* cited by examiner

*Primary Examiner*—Jacob K. Ackun
*Assistant Examiner*—Bena B. Miller
(74) *Attorney, Agent, or Firm*—Edward Goldberg

(57) ABSTRACT

A toy liquid storage tank includes an exterior cylindrical tank having a central vertical guide pole and a horizontally disposed flat roof. A motor gear drive mechanism linked to a pair of oppositely disposed cam lift arms raise and lower the roof along the guide pole. Roller wheels at the ends of the cams engage the roof to provide a smooth motion.

6 Claims, 3 Drawing Sheets

TOY LIQUID STORAGE TANK

BACKGROUND OF THE INVENTION

1. Field of the Invention

The present invention relates to a toy liquid storage tank having an internal mechanism which raises and lowers the roof to simulate the filling and emptying of liquid into and out of the storage tank. The device may be utilized in conjunction with a toy liquid transfer facility loading platform for simulating the transfer of liquids from the tank through a hose nozzle into a toy railroad tanker car fuel receptacle. The liquid transfer facility is the subject of copending application Ser. No. 09/950,371.

2. Description of the Prior Art

Previous devices for simulating movement of accessories utilized with toy train apparatus include miniature electric motors which control mechanical actions of the accessories, such as shown in U.S. Pat. No. 5,816,887 to Rudell et al.

U.S. Pat. No. 4,458,440 to D'Andrade et al. shows the use of a rotatable vertical screw type mechanism for raising and lowering an elevator platform carrying objects up and down within a vertical silo building connected to a toy barn.

U.S. Pat. No. Des. 195,041 to Genin et al. shows the external appearance of a water tower accessory for a toy railroad.

While these prior art devices show various mechanisms for simulating movement of toy train accessories, none of these concern a liquid storage tank having a roof raising and lowering mechanism which simulates the filling and emptying of liquid into and out of the storage tank.

SUMMARY OF THE INVENTION

It is therefore the primary object of the present invention to provide a novel mechanism for simulating the filling and emptying of a toy liquid storage tank.

It is another object of the invention to provide a unique mechanism for raising and lowering the roof of a toy liquid storage tank.

It is a further object of the invention to provide a motor-actuated gear drive and lift cam arm which control movement of the roof along a central vertical guide.

These objects are achieved with a unique structure including an exterior cylindrical tank shell having a central vertical guide and a horizontally disposed flat roof which rides up and down along the vertical guide. A motor and gear drive mechanism are linked to a pair of oppositely disposed lift cam arms which raise and lower the roof. Roller wheels at the ends of the cam arms engage the underside of the roof to provide a smooth motion. Other objects and advantages will become apparent from the following description in conjunction with the accompanying drawings.

DESCRIPTION OF THE PREFERRED EMBODIMENTS

Figure 1:
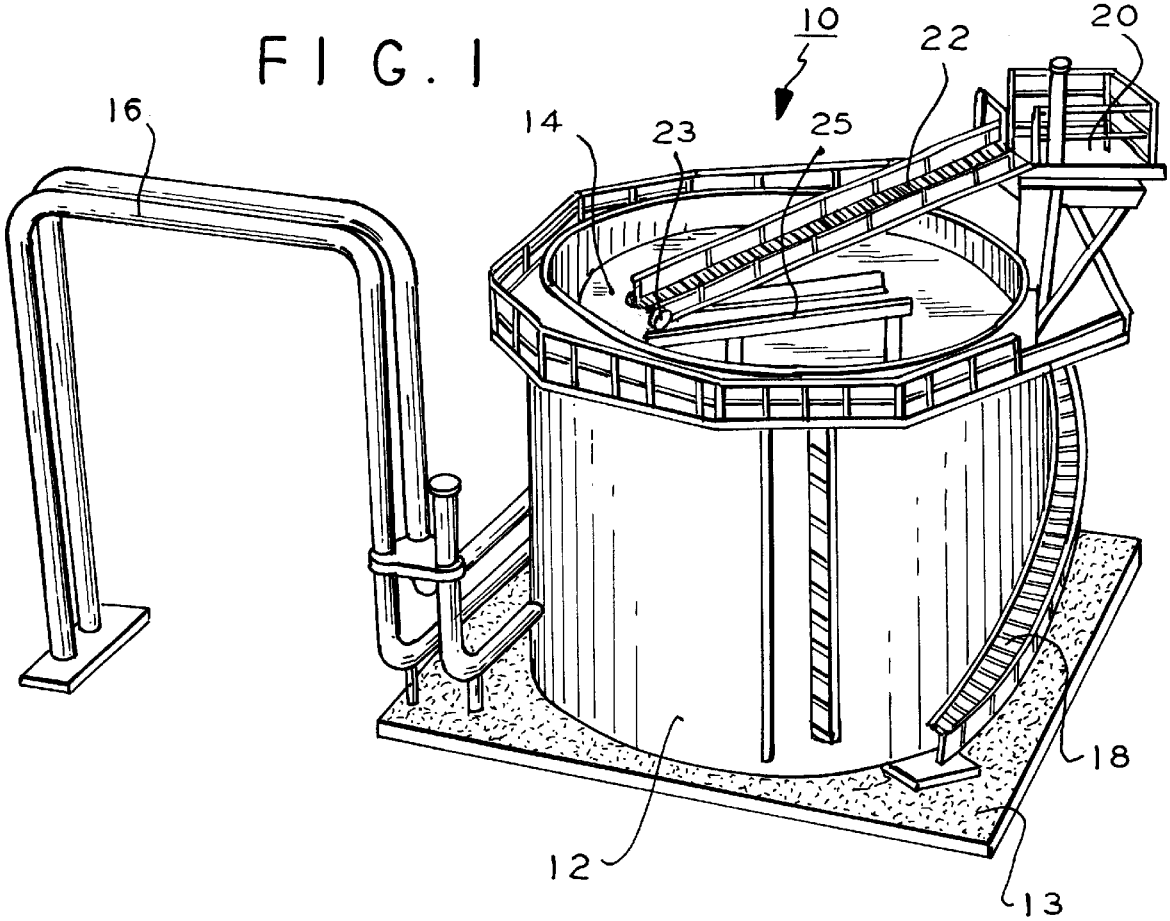
FIG. 1 is a front perspective view of the toy liquid storage tank with the roof in a raised position.

As shown in FIG. 1, the toy liquid storage tank 10 includes a cylindrical tank shell 12 supported on a base 13. The tank includes a floating roof 14 which moves vertically up and down within the tank to simulate the filling and emptying of liquid fuel stored within the tank. Pipelines 16 adjacent to the tank represent connections to fuel supply sources. Realistic associated external structures include a side spiral staircase 18, a work platform 20 alongside and above the tank and a moveable ladder 22 pivotally connected to the platform. The lower end of the ladder is connected to roller wheels 23 which ride on a guide 25 on the roof so that the ladder moves up and down with the roof. The up position of the roof simulates a full tank.

Figure 2:
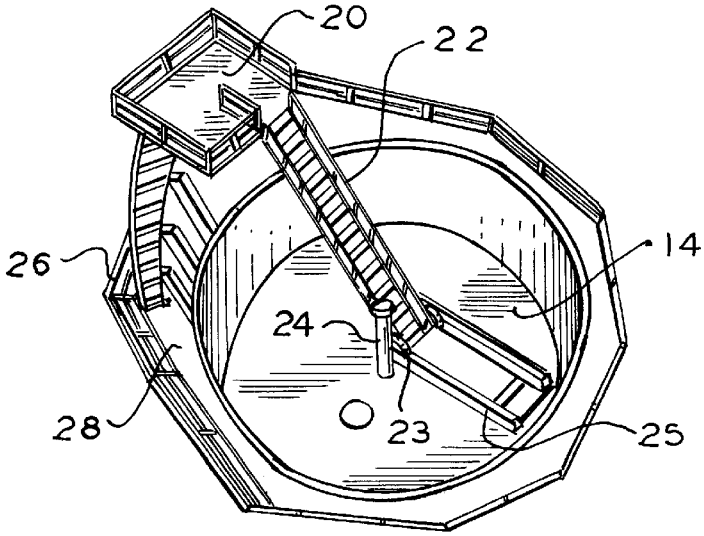
FIG. 2 is a perspective view of the storage tank from the top showing the roof in a lowered position.

As shown in FIG. 2, the roof 14 is in a lowered position along with the ladder simulating an empty tank. A centering pole 24 secured on base 13 aids in guiding the vertical movement of the roof to maintain a balanced level central position within the tank. A guard rail 26 encloses a circumferential skirt 28 around the upper end of the tank.

The operation of the roof raising and lowering mechanism is illustrated in FIGS. 3–6. An electric motor 30 mounted on base 13 is connected to an external source of power and control switch 31 and includes a pair of dual axle oppositely facing output shafts 32, 34 which rotate in the same direction. Each shaft is coupled to a first drive gear 36, 38. An intermediate gear 40 is coupled between gear 36 and a first output drive gear 42. Secured to output gear 42 is a crank lift roller pin 44 which rotates with gear 42. A first lift cam arm 46 is pivotable about a support axle 48 secured to a support 50 at one end of the lift cam arm. A first pair of roller wheels 52 are secured at the other end of cam arm 46.

Drive gear 38 on output shaft 34 on the opposite side of motor 30 is coupled to second output drive gear 54. A second crank lift roller pin 56 is secured to and rotates with gear 54. A second lift cam arm 58 is pivotable about a support axle 60 secured to support 62 at one end. A second pair of roller wheels 64 are secured at the other end of cam arm 58. Roof 14 rests on the two pairs of roller wheels 52, 64 which engage the underside of roof 14.

Figure 3:
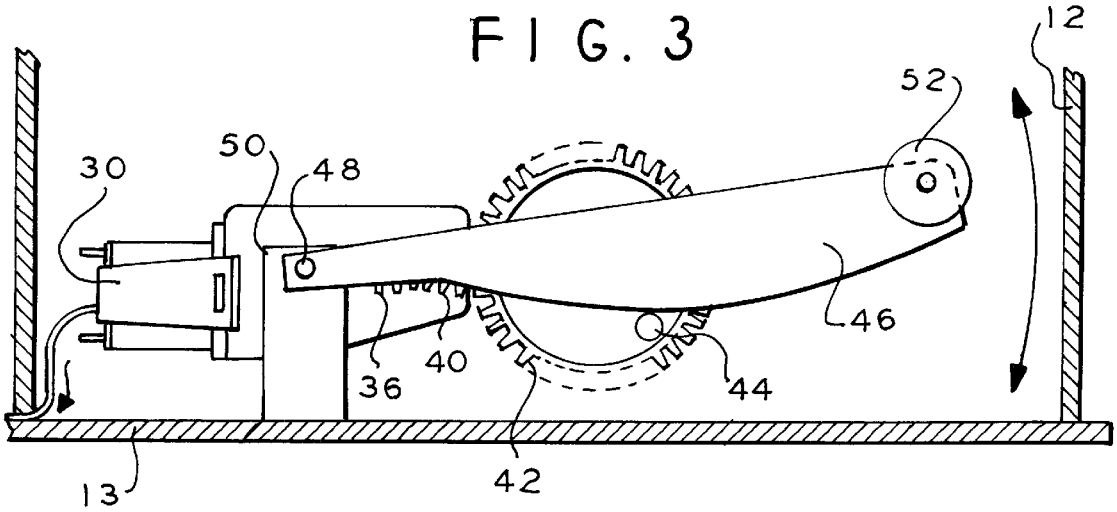
FIG. 3 is a schematic side view of the tank in partial cross section showing a portion of the mechanism for raising and lowering the roof.
Figure 4:
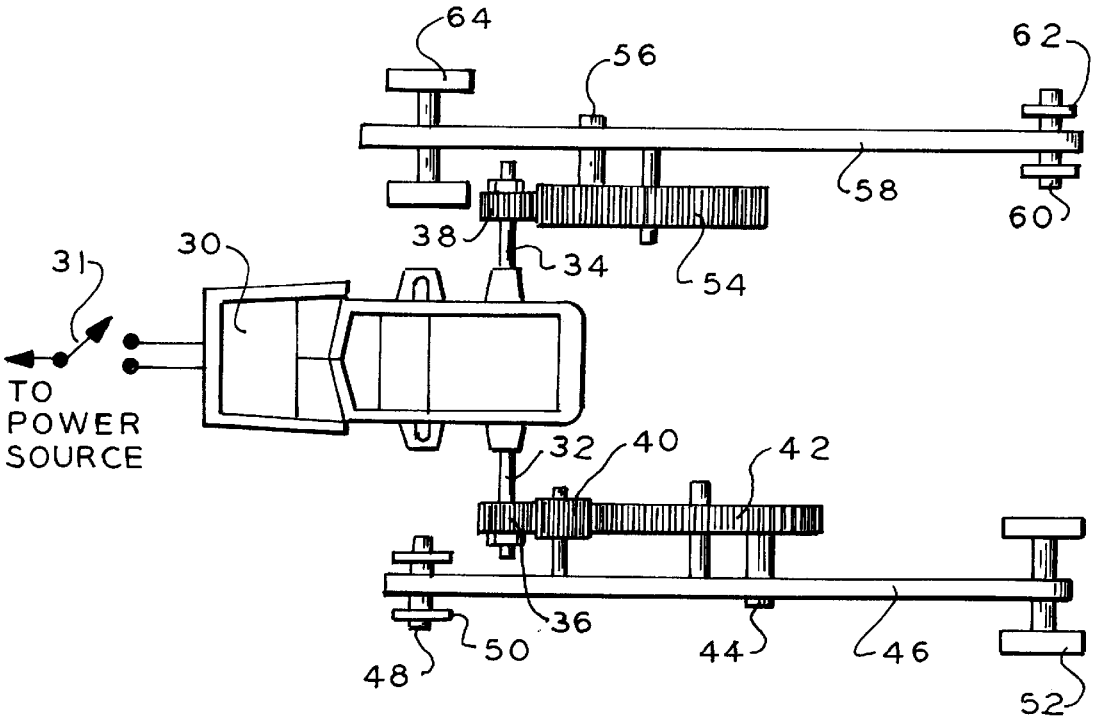
FIG. 4 is a schematic plan view of the mechanisms for raising and lowering the roof.
Figure 6:
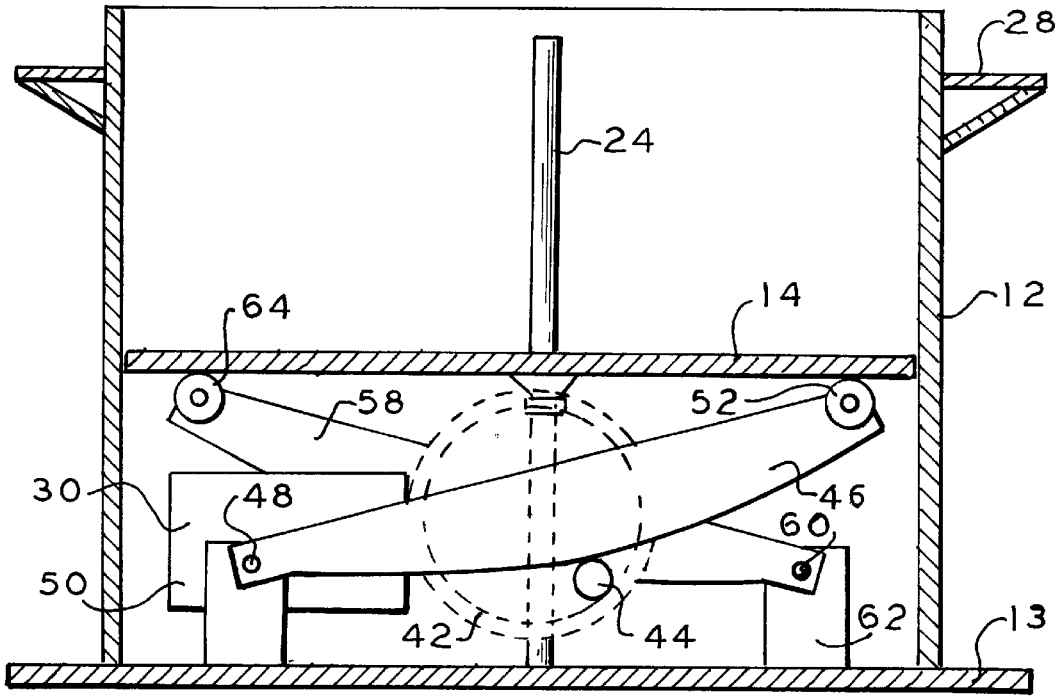
FIG. 6 is a schematic side view of the tank in partial cross section showing the roof in a lowered position.
Figure 5:
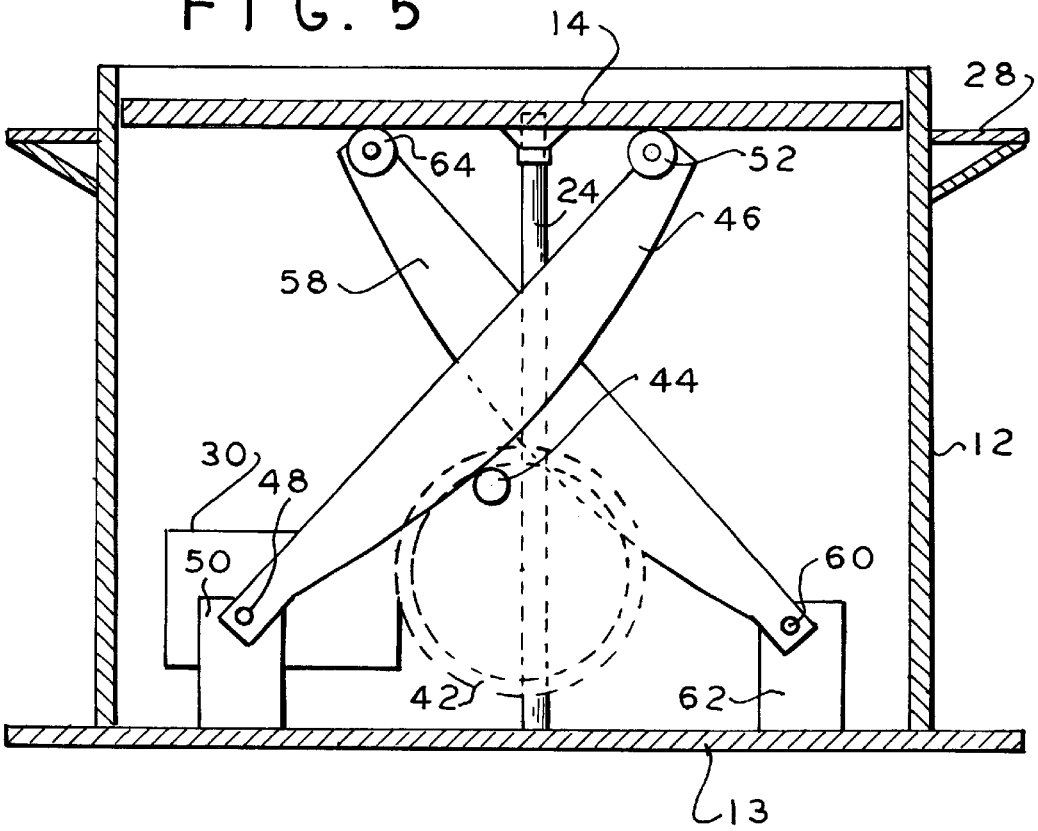
FIG. 5 is a schematic side view of the tank in partial cross section showing the roof in a raised position.

With the mechanism assumed to be in an initial starting position of an empty storage tank as shown in FIGS. 2, 3 and 6, the roof 14 and lift cam arms 46, 58 are in a lowered position. When motor 30 is actuated by the power control switch, dual shafts 32, 34 and drive gears 36, 38 start rotating in a counter clockwise direction. Intermediate gear 40 then rotates clockwise to then cause output drive gear 42 to rotate counterclockwise. Crank lift pin 44 also moves counterclockwise and in turn drives lift cam arm 46 to rotate counterclockwise about support axle 48. Roller wheels 52 at the other end of lift cam arm 46 are thus moved upwardly.

At the same time, the opposite shaft 34 and drive gear 38 are rotating counterclockwise to cause output drive gear 54 to rotate clockwise along with crank lift pin 56. This causes lift cam arm 58 to pivot clockwise about support axle 60 with roller wheels at the other end also moving upwardly. Both pairs of roller wheels engage the underside of roof 14 to raise the roof to the upper position shown in FIGS. 1 and 5. The movements of the two lift cam arms and gear drives are synchronized so that the roof moves smoothly and evenly in the upward direction with the central guide pole 24 maintaining a level balanced position. The dimensions of the various components are also coordinated to provide predetermined angular and vertical movement limitations to attain the upper position for simulation of the fill tank.

In order to reverse the operation and direction to attain a simulation of an empty tank, the electric motor control switch is moved to an opposite position. The shafts and drive gears then rotate clockwise with intermediate gear 40 rotating counterclockwise, and output gear 42 crank lift pin 44 and lift can arm 46 rotating clockwise. Roller wheels 52 then move downwardly. The opposite output drive gear 54 then rotates counterclockwise with crank lift pin 56 and lift cam arm 58 pivoting counterclockwise and roller wheels 64 also moving downwardly along the roof 14 guided by central pole 24 until the lowest empty tank position is attained. Intermediate positions and various up and down movements of the roof may be obtained by control of the motor power switch. The components may be varied in size to suit individual toy railway requirements. As a typical example, the storage tank may be about ten inches in height and ten inches in diameter.

While only a single embodiment has been illustrated and described, other variations may be made in the particular configuration without departing from the scope of the invention as set forth in the appended claims.

What is claimed is:

1. A toy liquid storage tank comprising:

a base, a hollow cylindrical shell mounted vertically on said base, a moveable roof fitting within and extending horizontally across said shell, and drive means mounted on said base within said shell, said drive means engaging said roof to move said roof vertically within said shell to simulate the filling and emptying of liquid in a storage tank.

2. The device of claim 1 including a central guide pole mounted vertically on said base, said roof having a central opening receiving said guide pole, said drive means moving said roof vertically along said guide pole.

3. The device of claim 1 wherein said drive means includes an electric motor having dual oppositely facing output shafts rotatable in the same direction, drive gears coupled to respective output shafts so that said drive gears coupled to said respective shafts rotate in opposite directions, a pair of cam lift arms each having one end pivotally mounted on said base on opposite sides of said central guide pole and having an opposite end movable vertically and engageable with said roof, and a pair of roller pins secured to respective oppositely rotating drive gears and engaging respective cam lift arms for moving said pair of cam lift arms and roof vertically along opposite sides of said central pole.

4. The device of claim 3 including pairs of roller wheels secured to respective opposite ends of said cam lift arms and engageable with said roof.

5. The device of claim 4 including a power control switch connected to said motor to change the direction rotation of said output shafts and direction of vertical movement of said cam lift arms and roof.

6. The device of claim 5 including a work platform secured at one side of said tank shell above said roof and a ladder pivotally connected at one end to said platform and having the other end slidable on said roof and movable vertically with said roof.

* * * * *